US006843400B1

(12) United States Patent
Lee

(10) Patent No.: US 6,843,400 B1
(45) Date of Patent: Jan. 18, 2005

(54) PNEUMATIC MOTOR DRIVING VALVE OF SCREW NAIL GUN

(76) Inventor: Yun-Chung Lee, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/666,782

(22) Filed: Sep. 22, 2003

(51) Int. Cl.[7] ..... B25B 17/00

(52) U.S. Cl. ..... 227/8; 227/136; 173/93.5; 81/434; 81/57.44

(58) Field of Search ..... 227/8, 130, 136; 173/93, 93.5; 81/434, 467, 57.37, 57.44

(56) References Cited

U.S. PATENT DOCUMENTS 5,730,035 A * 3/1998 Ohmori et al. ..... 81/57.44
5,862,724 A * 1/1999 Arata et al. ..... 81/434
5,996,874 A * 12/1999 Fukushima et al. ..... 227/8
6,026,713 A * 2/2000 Ohmori et al. ..... 81/57.44
6,089,132 A * 7/2000 Habermehl ..... 81/434
6,247,387 B1 * 6/2001 Ketteringham ..... 81/467
6,453,780 B2 * 9/2002 Habermehl ..... 81/434
6,672,404 B2 * 1/2004 Kamo et al. ..... 173/11

* cited by examiner

*Primary Examiner*—Scott A. Smith

(57) ABSTRACT

A pneumatic motor driving valve of a screw nail gun has a driving valve for control the pneumatic motor to be operated steadily. A downward pressing spring is installed around an outer wall of the cylinder of the gun body and an annular control valve is installed around the outer wall of the cylinder so that the annular control valve presses the downward pressing spring for actuating of the opening of the air inlet valve of the air inlet channel of the pneumatic motor. An annular control valve around an outer wall of the cylinder can accumulate the pressure in the gun body to a predetermined value so as to open the driving valve. Thereby, the pneumatic motor can provide a larger stable twisting force to beat and rotate a screw nail.

14 Claims, 8 Drawing Sheets

PNEUMATIC MOTOR DRIVING VALVE OF SCREW NAIL GUN

FIELD OF THE INVENTION

The present invention relates to screw nail gun, and particularly to a pneumatic motor driving valve of a screw nail gun which has an annular control valve on an outer wall of a cylinder of the gun body. In the present invention, valve can be opened by high pressure air and the pneumatic motor is actuate by the high pressure air.

BACKGROUND OF THE INVENTION

In one prior art about the pneumatic screw nail gun, a main air valve is installed between the pneumatic motor and the air diving path of the cylinder. The main air valve serves to control the actuation of the pneumatic motor and the cylinder in the gun body at the same time so that the nail locking rod can driving rod and descend to provide a twisting force to the screw nail so that the screw nail can be beaten into enter into the work piece. A cruciform portion at a front end of the nail locking rod is engaged to a cruciform groove in the screw nail. Thereby, the screw nail can be beaten into the work piece. Thus, the nail locking rod is locked.

However, in above prior art pneumatic screw nail gun, the main air valve serves to control the actuation of the pneumatic motor and the driving path of the cylinder in the gun body. Although the object of locking the screw nail is achieved, no device for accumulating air pressure in air driving path of the pneumatic motor is installed. As a result, when the pneumatic motor is driven by air pressure, the output twisting force is unstable. Especially, when a react force is generated because the screw nail is beaten into a work piece, the dynamic power of the pneumatic motor will reduce. Therefore when the air supplied to the pneumatic motor will be unstable. Thereby, the input air pressure cannot work with the downward pressing of the cylinder. Then the operation of the screw nail gun cannot be well controlled.

SUMMARY OF THE INVENTION

Accordingly, the primary object of the present invention is to provide a pneumatic motor driving valve of a screw nail gun, wherein a driving valve is disclosed for control the pneumatic motor to be operated steadily.

Another object of the present invention is to provide a pneumatic motor driving valve of a screw nail gun, wherein a downward pressing spring is installed around an outer wall of the cylinder of the gun body and an annular control valve is installed around the outer wall of the cylinder so that the annular control valve presses the downward pressing spring for control the actuation of the opening of air inlet valve of the air inlet channel of the pneumatic motor.

A further object of the present invention is to provide a pneumatic motor driving valve of a screw nail gun, wherein an annular control valve around an outer wall of the cylinder can accumulate pressure in the gun body to a predetermined value so as to open the driving valve. Thereby, the pneumatic motor can provide a larger stable twisting force to beat and rotate a screw nail.

The various objects and advantages of the present invention will be more readily understood from the following detailed description when read in conjunction with the appended drawing.

BRIEF DESCRIPTION OF THE DRAWINGS

FIG. 2(*a*) shows the cross section view along line a—a of FIG. 2 of the resent invention.

FIG. 2(*b*) is a cross section view along line b—b of the present invention.

DETAILED DESCRIPTION OF THE PREFERRED EMBODIMENTS

Figure 1:
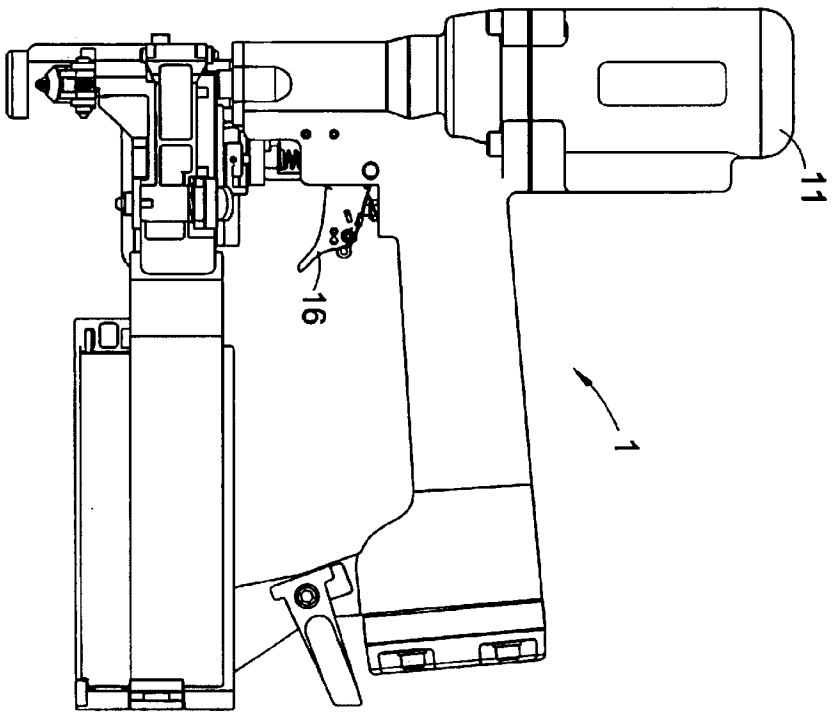
FIG. 1 is a front view of the present invention.

Referring to FIG. 1, the appearance of the screw nail gun 1 of the present invention is illustrated. It is illustrated from the FIG. 2 that the structure of the gun head 11 of the screw nail gun includes a pneumatic motor 2, a planet gear set 3, an output disk 4, a cylinder 5, a driving rod 6, a nail locking rod 62, a main air valve 7 and an annular control valve 8, etc.

The pneumatic motor 2 has a central spindle 27. A center of the spindle 27 has a rod groove 28. The pneumatic motor 2 has a plurality of blade receiving grooves 24 which are arranged as a radiating form for receiving blade set 29. A base plate 21 below the pneumatic motor 2 is formed with an air inlet chamber 22. One side of the air inlet chamber 22 is installed with an air inlet opening 23 (referring to FIGS. 2 and 2(*a*)). A portion of the air inlet chamber 22 communicated to the blade receiving groove 24 of the pneumatic motor 2 is installed with an booster opening 25. One lateral wall of the pneumatic motor 2 is formed with an exhausting opening 26. The exhausting opening 26 is communicated to the exhausting channel 14. The exhausting channel 14 is connected to the exhausting tube 15 in the handle of the gun body and is communicated to the outside so that the pneumatic motor 2 can be driven to rotate by the high pressure air 92 in the gun body 92 (referring to FIG. 4).

Figure 2:
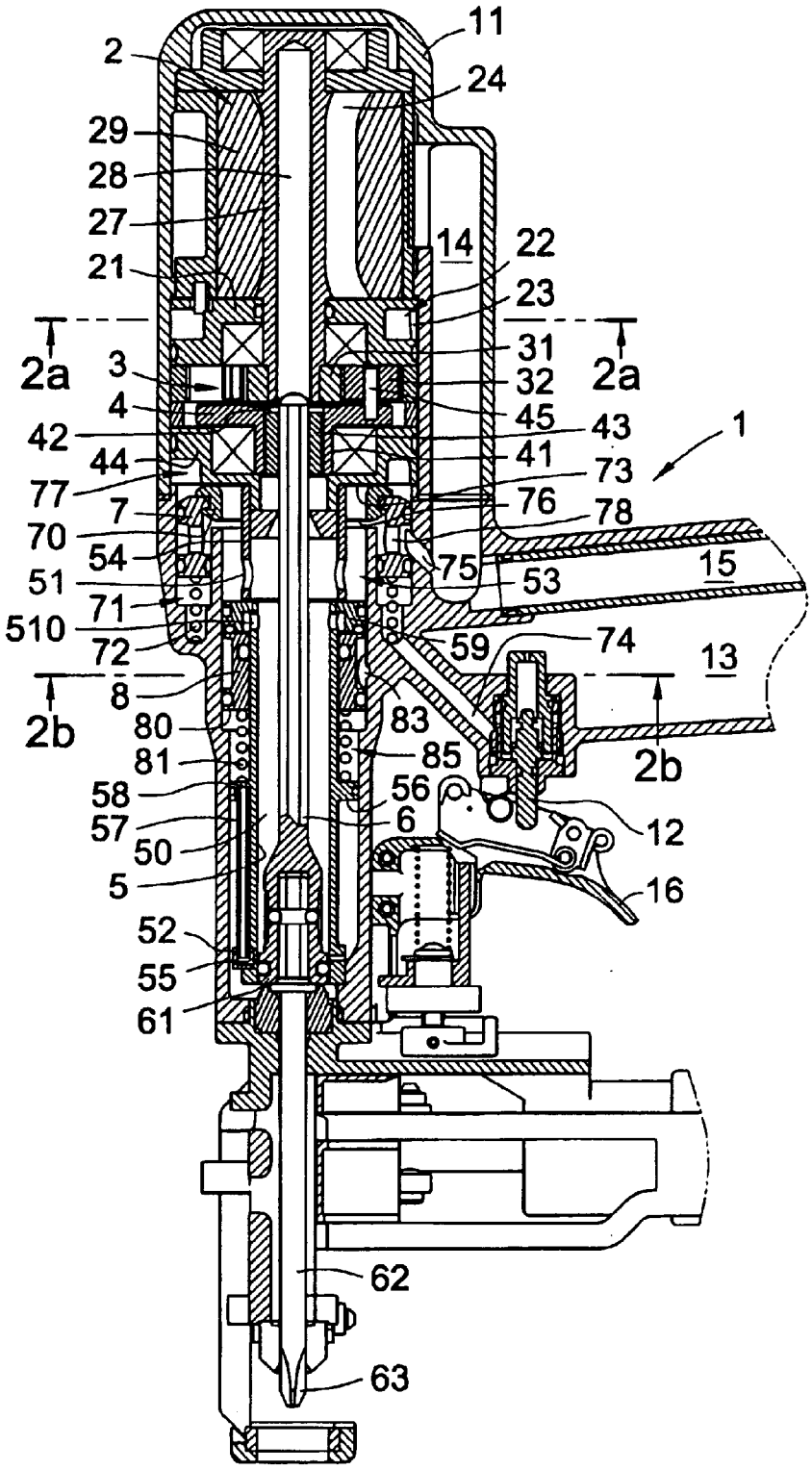
FIG. 2 is a schematic view about the gun head of the present invention.
Figure 2A:
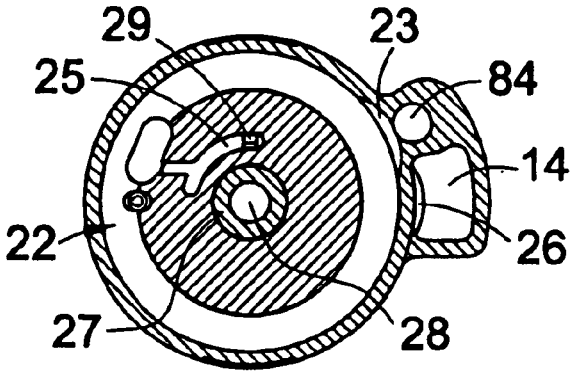
Figure 2B:
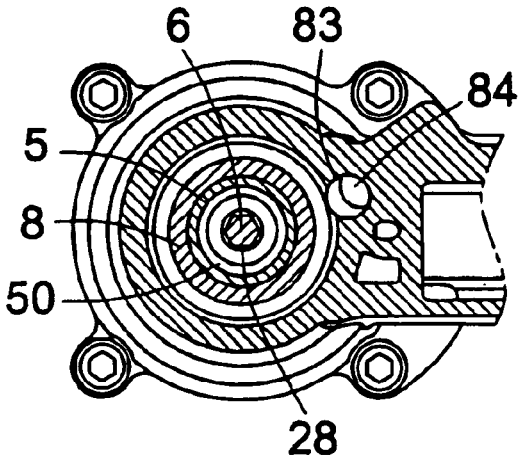

The planet gear set 3 is formed by a driving gear 31 and a plurality of driven gears 32 (referring to FIG. 2). The driving gear 31 is installed at a distal end of the spindle 27 of the pneumatic motor 2. The plurality of driven gears 32 are driven by the driving gear 31 and are around a periphery of the driving gear 31.

The output disk 4 is extended with a neck portion 41 which is pivotally installed to a bearing seat 44. A central receiving hole 42 is formed in the neck portion 41 and a bush 43 is located in the central receiving hole 42 for being connected with a driving rod 6. A disk surface of the output disk 4 is pivotally installed with a plurality of pivotal shafts 45 for pivotally installing with the plurality of driven gears 32. The number of pivotal shafts 45 is equal to that of the driven gears 32 (referring to FIG. 2) so that the output disk 4 can be driven by the planet gear set 3 to rotate and the bush 43 will drive the driving rod 6 to rotate.

The cylinder 5 is located near the lower edge of the bearing seat 44 (referring to FIG. 2 and FIG. 2(*b*)). The cylinder 5 has a cylinder chamber 50. An outer wall of the cylinder 5 is formed with an air resisting ring 56. Near an upper edge of the cylinder 5 has a plurality of air flowing holes 510 and near a lower edge of the cylinder 5 has a plurality of vent holes 55. An upper side of the cylinder 5 is formed with an inner air chamber 53. A spacing ring 54 is formed in the inner air chamber 53. An air mask 59 is disposed around peripheries of the air flowing holes 510 of the cylinder 5. A periphery of the spacing ring 54 has a plurality of via holes 51 for communicating the cylinder 5 and the inner air chamber 53 so that if necessary, high pressure air 92 can be loaded into the cylinder 5.

The driving rod 6 is movably installed to the rod groove 28 of the pneumatic motor 2 (referring to FIGS. 2 and 2(*b*)). The pneumatic motor 2 can drive the output disk 4 to rotate. Further, another end of the driving rod 6 has a movable piston 61 in the cylinder 5. A bottom of the piston 61 can be buckled to a nail locking rod 62. One end of the nail locking rod 62 is formed with a cruciform portion 63 which is able to engage to the cruciform groove of a screw nail (referring to FIG. 2) so that the driving rod 6 can be triggered by the high pressure air in the cylinder 5 and thus the screw nail 9 is triggered to move linearly.

A periphery of the top of the inner air chamber 53 is installed with a main gas piston 70 which is combined with another main air valve 7 (referring to FIG. 2). A top and a bottom of the main gas piston 70 have an upper valve opening 73 and a lower valve opening 76, respectively.

Figure 3:
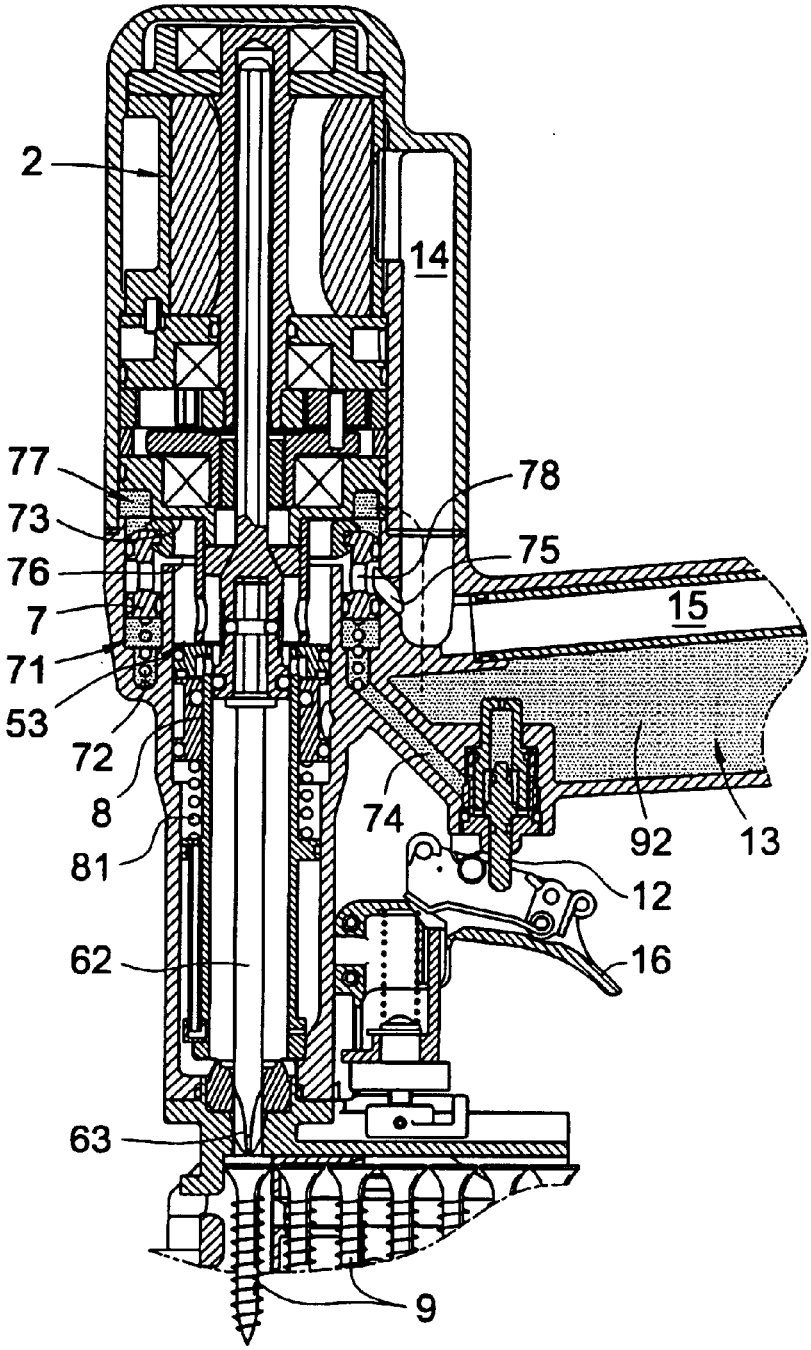
FIG. 3 is a cross section view showing a state before a trigger being pressed according to the present invention.

A periphery of the upper layer of the main air valve 7 and the main gas piston 70 are installed with a top layer air chamber 77 which is communicated to the air supply chamber 13 in the handle of the gun body so that in normal, high pressure air 92 can supply to the top layer air chamber 77 continuously (referring to FIG. 3). A bottom of the main air valve 7 has a middle layer air chamber 71 (referring to FIG. 2) for receiving and resisting against another main air compressing spring 72. A bottom of the middle layer air chamber 71 has a trigger air channel 74 which is communicated to a trigger valve 12. A middle section of the main air valve 7 is installed with a plurality of exhausting holes 78 which are communicated to the exhausting via holes 75 (referring to FIG. 2). When the lower valve opening 76 is opened, the high pressure air in the inner layer air chamber 53 can exhaust out to flow to the exhausting tube 15.

Figure 4:
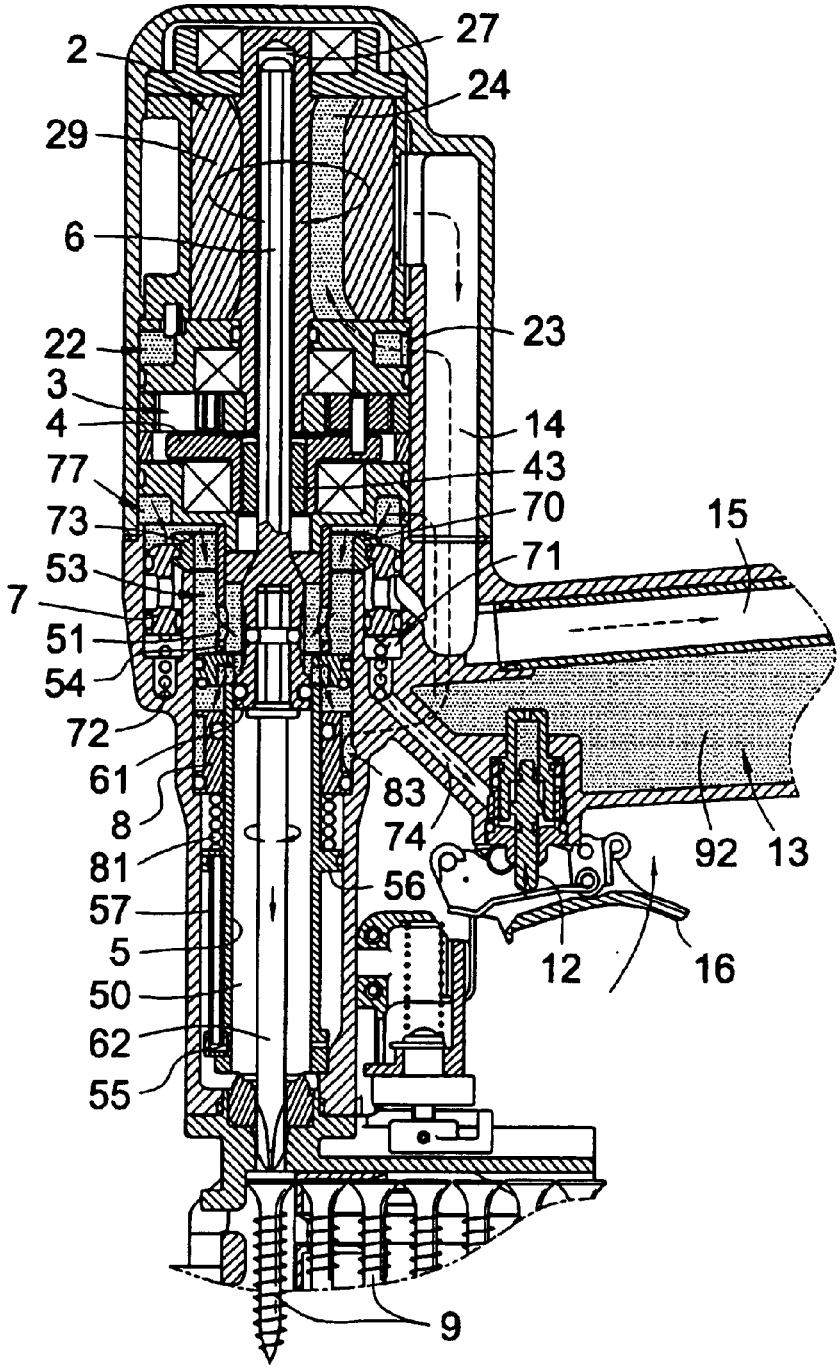
FIG. 4 is a cross section view showing the initial condition when the trigger is pressed according to the present invention.
Figure 7:
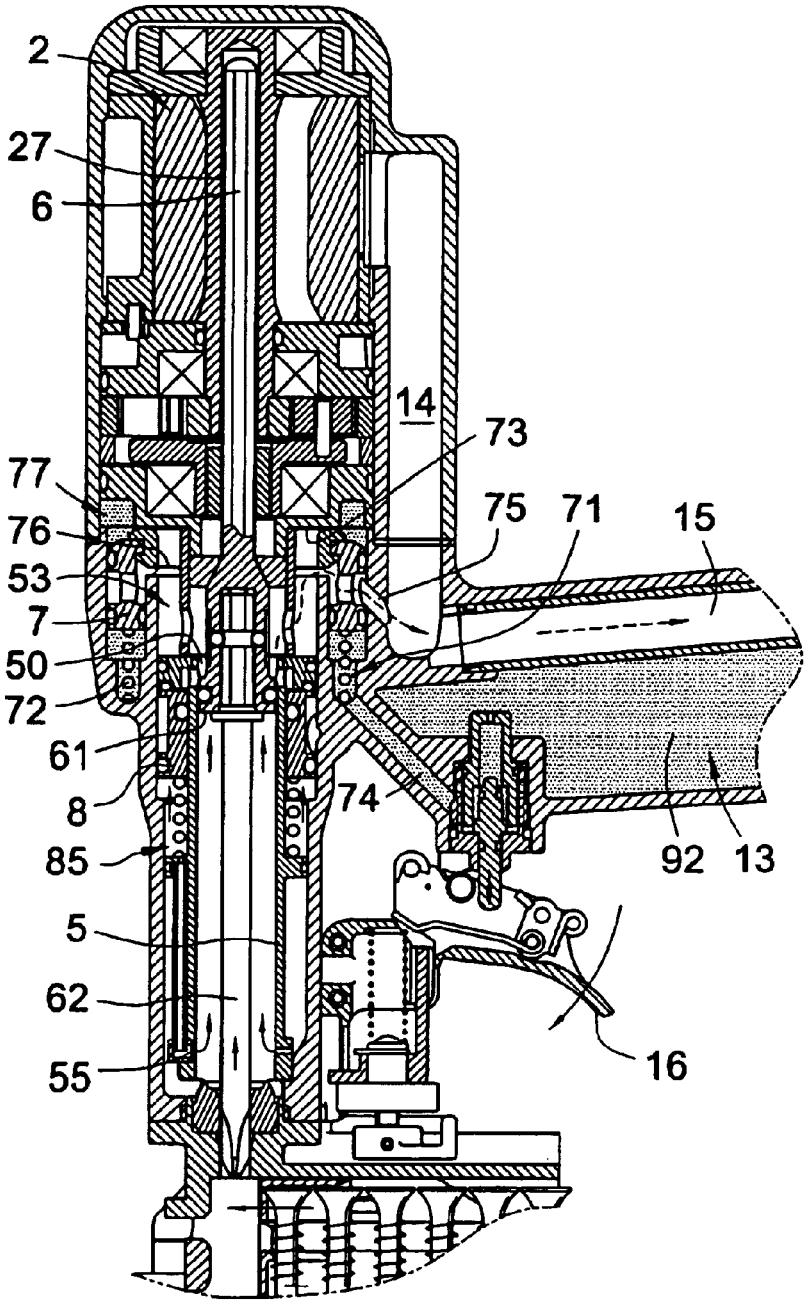
FIG. 7 is a cross section view showing the returning of the piston after the trigger is actuated according to the present invention.

When the upper valve opening 73 of the main air piston 70 is opened, the high pressure air 92 in the top layer air chamber 77 can be guided into the inner layer air chamber 53 (referring to FIG. 4). On the contrary, when the upper valve opening 73 is closed, the lower valve opening 76 will open (referring to FIG. 7). The high pressure air 92 will not flow into the inner layer air chamber 53. As a result, air in the inner layer air chamber 53 flow out for reducing pressure.

In the driving valve of the present invention, an outer wall of the cylinder 5 is engaged with a downward pressing spring 81 and an annular control valve 8 encloses the outer wall of the cylinder 5 (referring to FIG. 2). The downward pressing spring 81 resists against the air resisting ring 56 protruded from the cylinder 5. A protruded annular valve disk 80 is protruded from the annular control valve 8. An outer of the valve disk 80 and an inner wall of the annular control valve 8 have respective airtight O rings. An inner wall of the annular control valve 8 is pivotally installed to the outer wall of the cylinder 5 to be resisted by the downward pressing spring 81. Moreover, a top of the annular control valve 8 is airtightly engaged with a bottom of the air mask 59 or is communicated with the inner layer air chamber 53 through the air flowing holes 510.

A lower air chamber 85 is formed between a bottom of the annular control valve 8 and the air resisting ring 56 of the cylinder 5. The downward pressing spring 81 is received in the lower air chamber 85. A vent hole 55 at one side of the cylinder 5 is installed with a tube connector 52. The tube connector 52 is connected to one end of an air guiding tube 57. Another end of the tube connector 52 is connected to an air resisting ring 56. An air guiding hole 58 is formed on the air resisting ring 56 for connecting to the vent hole 55 and the lower air chamber 85 through the air guiding tube 57 (referring to FIG. 2).

The valve disk 80 of the annular control valve 8 serves to control an opening of air inlet valve 83 to open or close (referring to FIG. 2). The opening of air inlet valve 83 is communicated with an air inlet channel 84 (referring to FIG. 2(*b*)). The air inlet channel 84 is communicated with the air inlet opening 23 (referring to FIG. 2(*a*)).

By above components, when the screw nail gun is connected to a source of high pressure air 92, if the user does not press the trigger 16 (referring to FIG. 3), the trigger valve 12 is opened so that the high pressure air 92 in the air chamber 13 flows into the middle layer air chamber 71 through the trigger air channel 74 and resists against the bottom of the main air valve 7 by air pressure. Further, by the pressure of the main air compressing spring 72, a larger total pressure is applied to the top layer air chamber 77 at an upper layer of the main air valve 7 so as to supply air pressure continuously. Thereby, the upper valve opening 73 of the main air valve 7 is sealed continuously.

Figure 5:
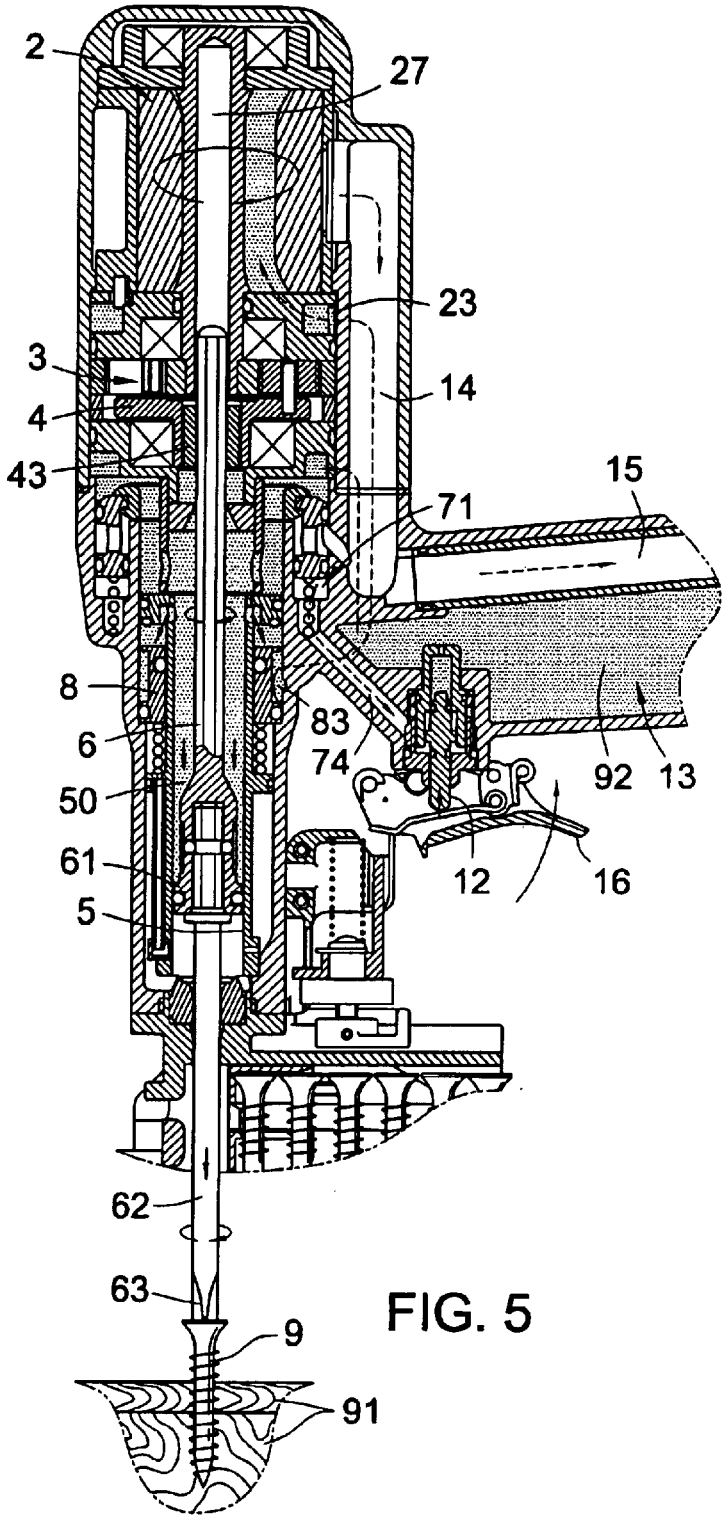
FIG. 5 shows the cross section view showing the movement of the piston after the trigger is pressed according to the present invention.

Next, when the user presses the trigger 16 (referring to FIG. 4), the high pressure air 92 in the trigger valve 12 is closed and the trigger air channel 74 is communicated to the outer side so that the high pressure air 92 in the middle layer air chamber 71 previously drains out. Then, the high pressure air 92 supplied to the top layer air chamber 77 at the periphery of the main air compressing spring 72 and the main air valve 7 is larger than the pressure of the main air compressing spring 72 in the middle layer air chamber 71 and the upper valve opening 73 is opened so that the high pressure air 92 flows into the inner layer air chamber 53. Then the air flows through the plurality of via holes 51 to enter into the cylinder chamber 50 to push the piston 61 to move downwards to beat the screw nail (referring to FIG. 5).

When the high pressure air 92 flows into the inner layer air chamber 53 (referring to FIG. 4), the pressure will increase continuously. Other than pushing the piston 61 to move outwards, the high pressure air 92 in the inner layer air chamber 53 will boost to flow into the via hole 51, air flow hole 510 to push the annular control valve 8 below the air mask 59. When the air pressure of the high pressure air 92 in the inner layer air chamber 53 is larger than the pressure of the downward pressing spring 81 at the bottom of the annular control valve 8, the annular control valve 8 moves downwards to press the downward pressing spring 81 and open the opening of air inlet valve 83 so that the high pressure air 92 flows through the opening of air inlet valve 83, air inlet channel 84 (referring to FIG. 2(*b*), air inlet opening 23, air inlet chamber 22 to drive the blade set 29 of the pneumatic motor 2 to rotate for driving the spindle 27 of the pneumatic motor 2 to steadily output high twisting force and to drive the planet gear set 3 to rotate the output disk 4. Then the output disk 4 will drive the driving rod 6 and the nail locking rod 62 at the bottom thereof to rotate (referring to FIG. 5). Thereby, when the piston 61 to move downwards to beat the nail, the screw nail 9 will beat the work piece 91.

Figure 6:
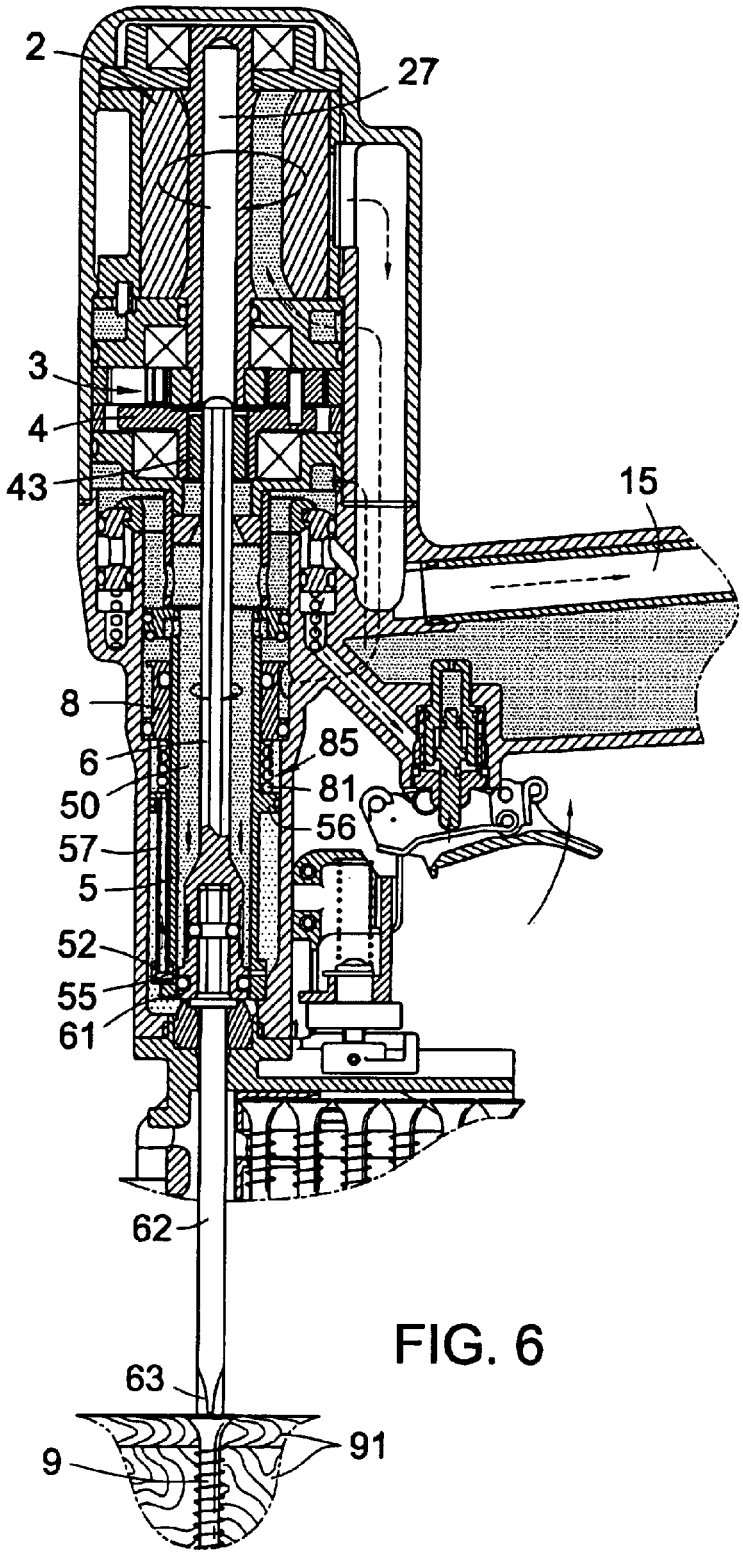
FIG. 6 is a cross section view showing that the piston moves to a lower point after the trigger is pressed according to the present invention.

Then, when the piston 61 moves downwards to a lower point to beat the screw nail 9 completely into the work piece 91 (referring to FIG. 6), the vent hole 55 at the bottom of the cylinder 5 will be opened so that the high pressure air 92 in the cylinder 5 will drain into the lower air chamber 85 through the vent hole 55, tube connector 52, and the air guiding tube 57 so as to increase the pressure of the downward pressing spring 81 so as to form force for closing the valve at the bottom of the control valve 8 so that the control valve 8 moves upwards to close the opening of air inlet valve 83 (referring to FIG. 7) to stop to the pneumatic motor 2 so as to stop the movement of the screw nail 9.

Then when the user releases the trigger 16 (referring to FIG. 7), the trigger valve 12 returns to the original open state so that the middle layer air chamber 71 will re-accumulate high pressure air 92 so as to assist the main air compressing spring 72 to overcome the pressure in the top layer air chamber 77. Thus the main air valve 7 returns to a state of closing the upper valve opening 73. At this time, the lower valve opening 76 is opened, so that the remain high pressure air 92 in upper layer of the piston 61 and the inner layer air chamber 53 passes through the exhausting channel 14 and the exhausting tube 15 to vent to the outside so that the original high pressure air 92 in the lower air chamber 85 returns to the lower side of the piston 61 and the cylinder chamber 50 through the vent hole 55 to push the piston 61 and the driving rod 6 to move upwards to return to the original state and the nail locking rod 62 retracts so as to complete the cycle of the beating and rotating the screw nail 9.

Therefore from above description, it is known that in the present invention, the annular control valve serves to accumulate and control the high pressure air to enter into the pneumatic motor so as to control the pneumatic motor steadily and the twisting force from the pneumatic motor is increased so that the operation of beating the screw nail is more successful.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A pneumatic motor driving valve of a screw nail gun being assembled to an opening of an air inlet valve of an air inlet channel of a pneumatic motor; the screw nail gun having a gun body; the gun body having at least one cylinder capable of receiving high pressure air; and a driving rod installed in the cylinder; one end of the driving rod being connected to a piston; the piston being able to be actuated by the high pressure air to beat a screw nail to move linearly; another end of the driving rod being driven by the pneumatic motor to generate power to rotate the screw nail; the driving valve comprising:

a downward pressing spring on an outer wall of the cylinder;

an annular control valve pivotally installed on an outer wall of the cylinder; the annular control valve pressing and located above the downward pressing spring; a valve disk protruding from the annular control valve for controlling opening and closing of an opening of the air inlet valve;

a top of the annular control valve being communicated to an inner layer air chamber; when high pressure air is accumulated in the inner layer air chamber; the annular control valve being pushed to press the downward pressing spring so as to open the opening of air inlet valve; and thus the high pressure air being loaded into the air inlet channel for driving the pneumatic motor to rotate; and a bottom of the annular control valve having a lower air chamber for receiving exhausting-high pressure air from the cylinder so as to push the annular control valve to move upwards with the downward pressing spring to close the opening of air inlet valve; thus the pneumatic motor stops.

2. The pneumatic motor driving valve of a screw nail gun as claimed in claim 1, wherein an outer wall of the cylinder has an air resisting ring for resisting against the downward pressing spring; the air resisting ring and a bottom of the annular control valve is formed with a lower air chamber.

3. The pneumatic motor driving valve of a screw nail gun as claimed in claim 1, wherein an air guiding hole is formed on the air resisting ring and is connected to an air guiding tube; the air guiding tube is connected to an exhausting hole near a lower edge of the cylinder.

4. The pneumatic motor driving valve of a screw nail gun as claimed in claim 1, wherein an air flow hole is formed near an upper edge of the cylinder; and a periphery of the air flow hole is covered by an air mask; thereby a top of the annular control valve being communicated to an inner layer air chamber.

5. The pneumatic motor driving valve of a screw nail gun as claimed in claim 1, wherein the inner layer air chamber is located above the cylinder; and the inner layer air chamber has a spacing ring; a periphery of the spacing ring has a plurality of via holes for guiding the high pressure air in the inner layer air chamber to an cylinder chamber of the cylinder.

6. The pneumatic motor driving valve of a screw nail gun as claimed in claim 5, wherein the via holes on the spacing ring serves to guide the high pressure air in the inner layer air chamber to press the annular control valve.

7. The pneumatic motor driving valve of a screw nail gun as claimed in claim 1, wherein a top of the inner layer air chamber is installed with a main air piston and a main air valve communicated to the main air piston.

8. The pneumatic motor driving valve of a screw nail gun as claimed in claim 7, wherein a bottom of the main air valve has a middle layer air chamber; and the main air valve presses a main air compressing spring; a bottom of the middle layer air chamber is a trigger air guiding hole which is communicated to the trigger valve.

9. The pneumatic motor driving valve of a screw nail gun as claimed in claim 7, wherein a top of the main air compressing spring has an upper valve opening, and a bottom thereof has a lower valve opening.

10. The pneumatic motor driving valve of a screw nail gun as claimed in claim 9, wherein when the upper valve opening is opened, high pressure air in the top layer air chamber flows into the inner layer air chamber continuously to push the annular control valve to open and thus to drive the pneumatic motor to rotate.

11. The pneumatic motor driving valve of a screw nail gun as claimed in claim 9, wherein when the lower valve opening is opened, the upper valve opening is closed so that the high pressure air in the inner layer air chamber drains out to push the annular control valve to close the opening of air inlet valve and the pneumatic motor stops to operation.

12. The pneumatic motor driving valve of a screw nail gun as claimed in claim 7, wherein a middle section of the main air valve has a plurality of exhausting holes; thereby the high pressure air in the inner layer air chamber exhausts from the via holes and the exhausting tubes on the gun body to outside.

13. The pneumatic motor driving valve of a screw nail gun as claimed in claim 1, wherein a top layer air chamber is formed around the main air valve and the main air piston; the top layer air chamber is communicated to an air supply chamber of a handle of the gun body so that high pressure air is supplied to the top layer air chamber.

14. The pneumatic motor driving valve of a screw nail gun as claimed in claim 1, wherein near a lower edge of the cylinder has a plurality of vent holes; an outer side of the vent holes is installed with a tube connector; the tube connector is connected to one end of an air guiding tube; another end of the tube connector is connected to an air resisting ring; an air guiding hole is formed on the air resisting ring for connecting to the vent hole and the lower air chamber through the air guiding tube so that the high pressure air in the cylinder drains out to the lower air chamber.

* * * * *